US007871185B2

(12) United States Patent
Suzuki

(10) Patent No.: US 7,871,185 B2
(45) Date of Patent: Jan. 18, 2011

(54) LAMP FIXTURE

(75) Inventor: Hiroshi Suzuki, Inzai (JP)

(73) Assignees: Hyundai Motor Company, Seoul (KR); Kia Motors Corporation, Seoul (KR); Hyundai Motor Japan R&D Center Inc., Inzai (JP)

( * ) Notice: Subject to any disclaimer, the term of this patent is extended or adjusted under 35 U.S.C. 154(b) by 266 days.

(21) Appl. No.: 12/231,910

(22) Filed: Sep. 5, 2008

(65) Prior Publication Data

US 2009/0122555 A1 May 14, 2009

(30) Foreign Application Priority Data

Sep. 7, 2007 (KR) ..... 10-2007-0091139

(51) Int. Cl.
*F21V 11/00* (2006.01)

(52) U.S. Cl. ..... 362/351; 362/326; 362/305

(58) Field of Classification Search ..... 362/351, 362/326, 308, 329, 305, 241, 540
See application file for complete search history.

(56) References Cited

U.S. PATENT DOCUMENTS

| | | | | |
|---|---|---|---|---|
| 2,823,477 | A * | 2/1958 | Willard | 40/554 |
| 5,876,109 | A * | 3/1999 | Scalco | 362/104 |
| 6,729,746 | B2 * | 5/2004 | Suehiro et al. | 362/241 |
| 6,742,915 | B1 * | 6/2004 | Westerheide | 362/360 |
| 6,821,002 | B1 * | 11/2004 | Morgen | 362/351 |
| 7,399,091 | B2 * | 7/2008 | Lockett et al. | 353/120 |
| 2006/0176704 | A1 * | 8/2006 | Gordin et al. | 362/351 |

* cited by examiner

*Primary Examiner*—Ali Alavi
(74) *Attorney, Agent, or Firm*—Morgan, Lewis & Bockius LLP

(57) ABSTRACT

A lamp fixture has a hollow shape, such as a pyramid or a cone. The fixture includes a light source mount at a vertex of the shape, configured for light from a light source to enter the shape therethrough; reflecting inner surfaces on sides of the shape; and a design element on or in at least one of the sides. The design element may be a slit, a hole, a transparent element, a color pattern, a three-dimensional object, a prominence, an uneven surface, or a combination thereof.

8 Claims, 12 Drawing Sheets
(5 of 12 Drawing Sheet(s) Filed in Color)

shape generation part
three- dimensional object

LAMP FIXTURE

CROSS-REFERENCE TO RELATED APPLICATIONS

This application claims priority to Korean Application No. 10-2007-0091139, filed on Sep. 7, 2007, the disclosure of which is incorporated herein by reference.

BACKGROUND OF THE INVENTION

1. Field of the Invention

The present invention relates generally to a lamp fixture that is used to improve the aesthetics of a lighting device. The lamp fixture may be used for a vehicle lamp (such as a rear combination lamp, a head lamp, a fog lamp, a center high-mount stop lamp, or a backup lamp), or in any lighting fixture.

2. Description of the Related Art

A traditional vehicle lamp includes a lens disposed in front of an incandescent light bulb. Recently, light-emitting diodes (LEDs) are being used instead of incandescent bulbs. LEDs are advantageous in terms of power consumption and response time, but disadvantageous in cost and irradiation angle range (typically ~40-60°). Several LEDs must be used in a single lamp to provide the necessary irradiation range.

Further, all vehicle lamps have similar appearances, regardless of individual vehicle owners' tastes.

The information disclosed in this Background of the Invention section is only for enhancement of understanding of the background of the invention and should not be taken as an acknowledgement or any form of suggestion that this information forms the prior art that is already known to a person skilled in the art.

SUMMARY OF THE INVENTION

A lamp fixture has a hollow shape, such as a pyramid or a cone. The fixture includes a light source mount at a vertex of the shape, configured for light from a light source to enter the shape therethrough; reflecting inner surfaces on sides of the shape; and a design element on or in at least one of the sides. The design element may be a slit, a hole, a transparent element, a color pattern, a three-dimensional object, a prominence, an uneven surface, or a combination thereof.

The transparent element may have a color. The three-dimensional object may have a color and/or a reflecting surface. The design element may be defined by a straight line, a curve, and/or a figure. The design element may be on or in at least two of the sides. The light source mount may be a slanted opening. At least one of the sides may be curved. The lamp fixture may be mounted adjacent an additional lamp fixture such that the light sources of the two fixtures are aligned.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The above and other features of the present invention will now be described in detail with reference to certain exemplary embodiments thereof illustrated the accompanying drawings which are given by way of illustration, and are not limitative of the present invention, and wherein:

FIGS. 5A and 5B are views showing a lamp fixture according to another embodiment, in which FIG. 5A is a view before three-dimensional objects are fastened to the reflecting surfaces of the lamp fixture, and FIG. 5B is a view after the three-dimensional objects have been fastened thereto;

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

DESCRIPTION OF THE PREFERRED EMBODIMENTS

Lamp fixtures according to preferred embodiments of the present invention are described in detail with reference to the accompanying drawings below.

FIGS. 1A through 2B show a lamp fixture having a hollow triangular pyramid shape. A light source mounting part, in which a light source is disposed, is provided at a rear vertex. Inner surfaces of some sides have reflecting surfaces thereon. The outer surfaces of these sides are covered with an opaque material (light non-transmitting layer). Slits are provided in these sides, near one vertex, as shown in FIGS. 1C and 1D. When the lamp fixture is in ambient light, light enters through the slits and is reflected by the reflecting surfaces, creating various geometrical shapes.

Figure 1A:
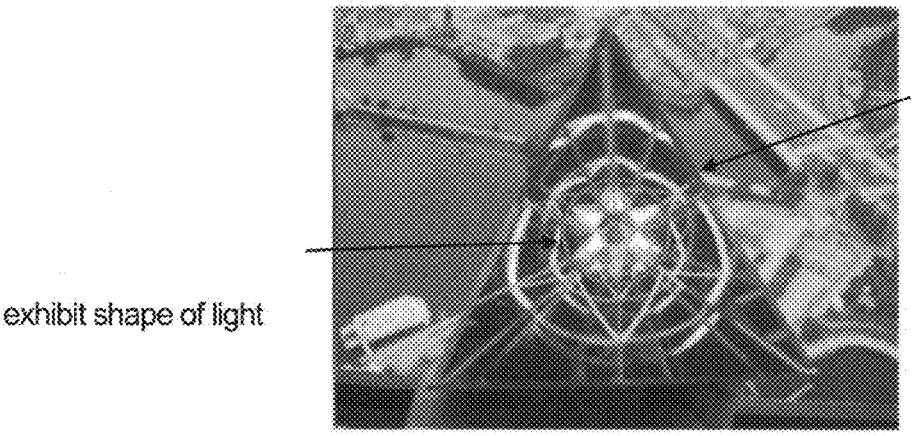
FIG. 1A is a front view of a lamp fixture according to an embodiment.
Figure 1B:
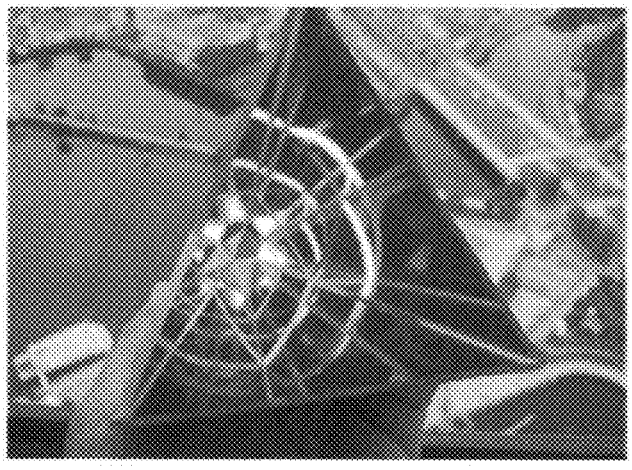
FIGS. 1B-1D are other views of the lamp fixture shown in FIG. 1A.
Figure 1C:
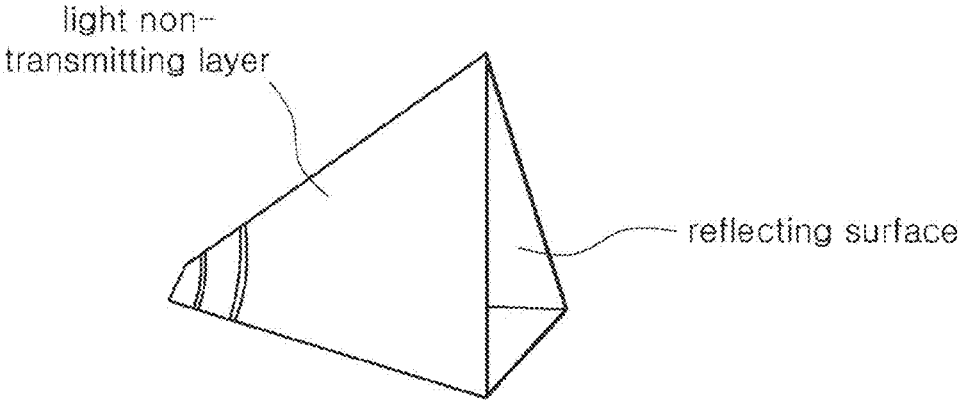
Figure 1D:
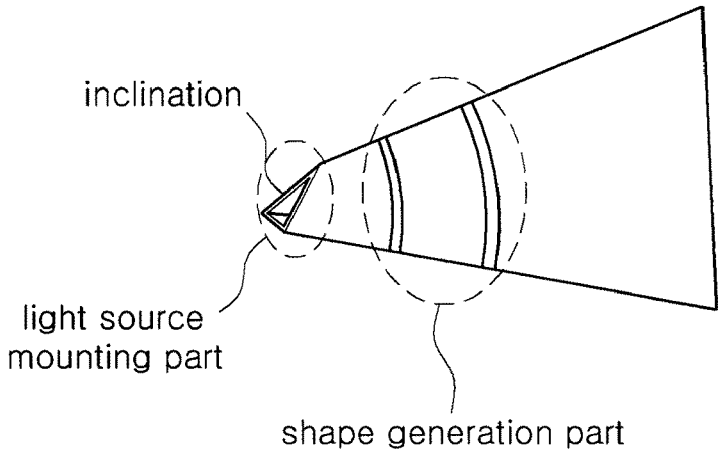
Figure 2A:
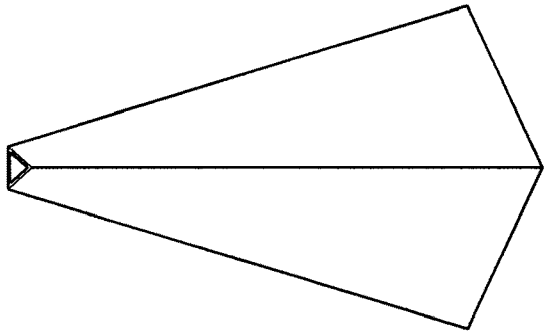
FIG. 2A is a plan view of the lamp fixture shown in FIG. 1A.
Figure 2B:
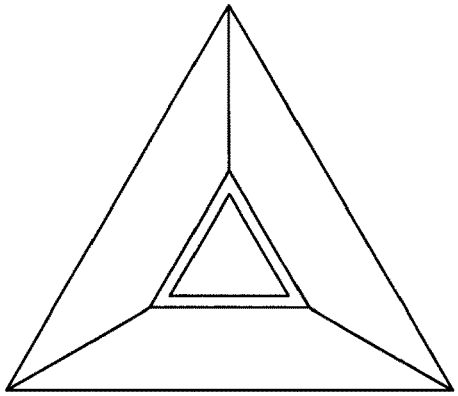
FIG. 2B is a rear view of the lamp fixture shown in FIG. 1A.

The light source mounting part may be formed by cutting off one vertex of the lamp fixture at a slant, providing an opening (FIG. 1D). As shown in FIGS. 1A and 1B, light that enters through such a slanted opening is reflected by the reflecting surfaces, and thus a star-shaped figure is seen. If the opening were not slanted, a sphere would be seen.

The slits may include two parallel curved slits in the sides near the light source mounting part. The slits may be circular arcs with centers located on the side of the light source mounting part. As an example, as shown in FIGS. 1A and 1B, a shape in which two spheres seem to overlap each other from the light source mounting part is created. This shape forms a three-dimensional shape together with the star-shaped figure, which is created by the light that has entered through the opened part.

Instead of or in addition to the slits, light transmitting elements, such as transparent material or holes, may be provided. The transparent material may have colors. When light enters into the lamp fixture through the light transmitting elements, the above-described three-dimensional shape is created, so that the light transmitting elements may be called design elements, or shape generation parts.

In FIGS. 1A and 1B, the light source, which will be disposed in the opening, is not shown. When sunlight enters the lamp fixture through the light transmitting elements, whether or not the light source is turned on, the three-dimensional shape or pattern shown in FIGS. 1A and 1B may be created. Excellent aesthetics can thus be provided using ambient light even when the lamp source is not on.

Figure 3A:
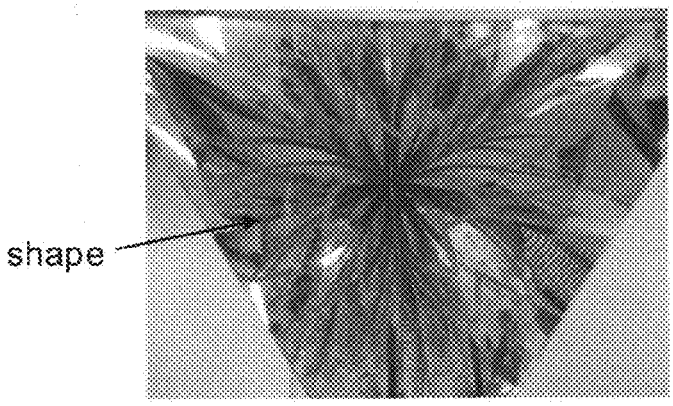
FIG. 3A is a front view of a lamp fixture according to another embodiment.
Figure 3B:
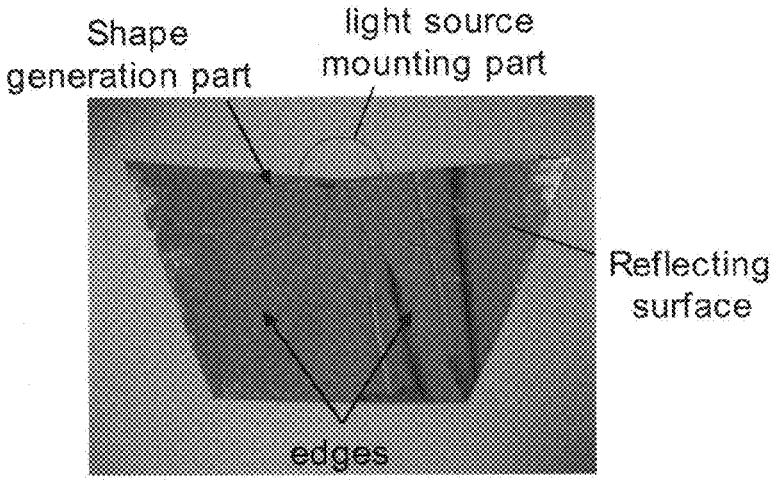
FIG. 3B is another view of the lamp fixture shown in FIG. 3A.

FIGS. 3A and 3B show a lamp fixture having another type of shape generation part. As shown in FIG. 3B, a color pattern, having the shape of a maple leaf, is drawn on the reflecting surfaces located near the light source mounting part. Then the edges are folded, creating the three-dimensional floral pattern shown in FIG. 3A. The color pattern of FIG. 3B may be painted on, or may be created by preventing the corresponding portions of the color pattern from being plated, such as by masking. As an example, in the case where the background color of the lamp fixture is red, a red color pattern can be achieved. Meanwhile, the shape generation part, shown in FIG. 3B, may be formed by coloring transparent elements. In this case, light enters into the lamp fixture through the transparent elements having colors, so that a greater variety of three-dimensional shapes can be created on the reflecting surfaces of the lamp fixture.

Figure 4:
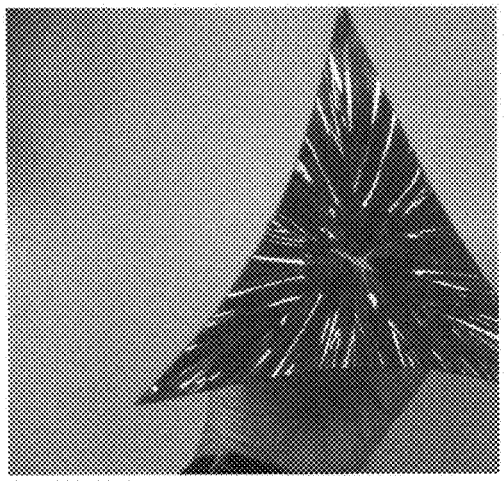
FIG. 4 is a front view of a lamp fixture according to another embodiment.

FIG. 4 illustrates a lamp fixture with side planes concavely bent inwards. The light creates the shape of a streak of light, which streams forwards from a rear light source mounting part. A shape generation part may also be provided on or in the side planes of the lamp fixture, showing a greater variety of shapes.

Figure 5A:
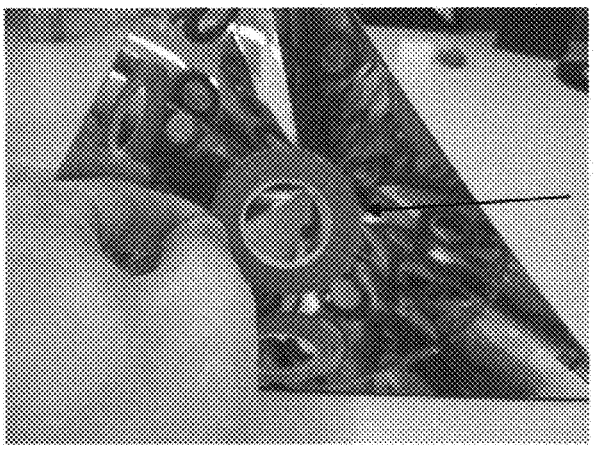
Figure 5B:
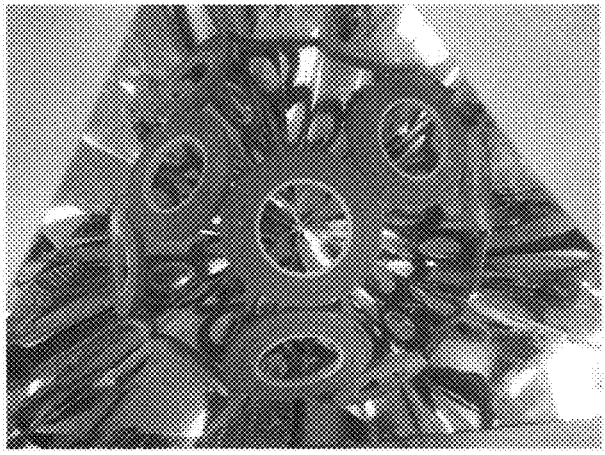

An alternative shape generation part is shown in FIGS. 5A and 5B. As shown in FIG. 5A, three-dimensional objects are placed on the reflecting surfaces, showing the shapes seen in FIG. 5B. Of course, the size, shape, color, and position of the three-dimensional objects can vary.

Figure 6A:
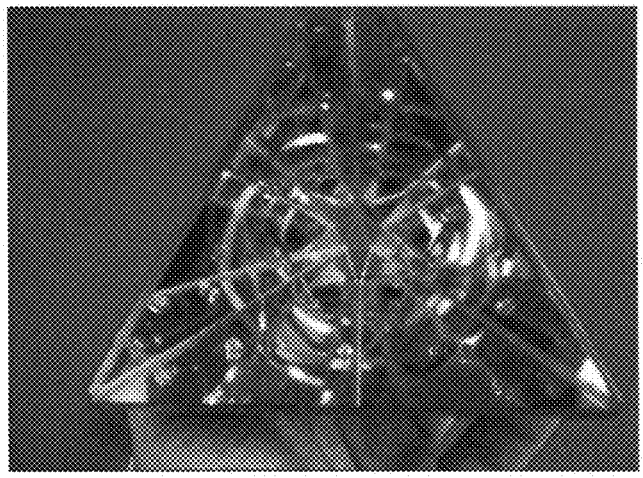
FIG. 6A is a front view showing a lamp fixture according to another embodiment.
Figure 6B:
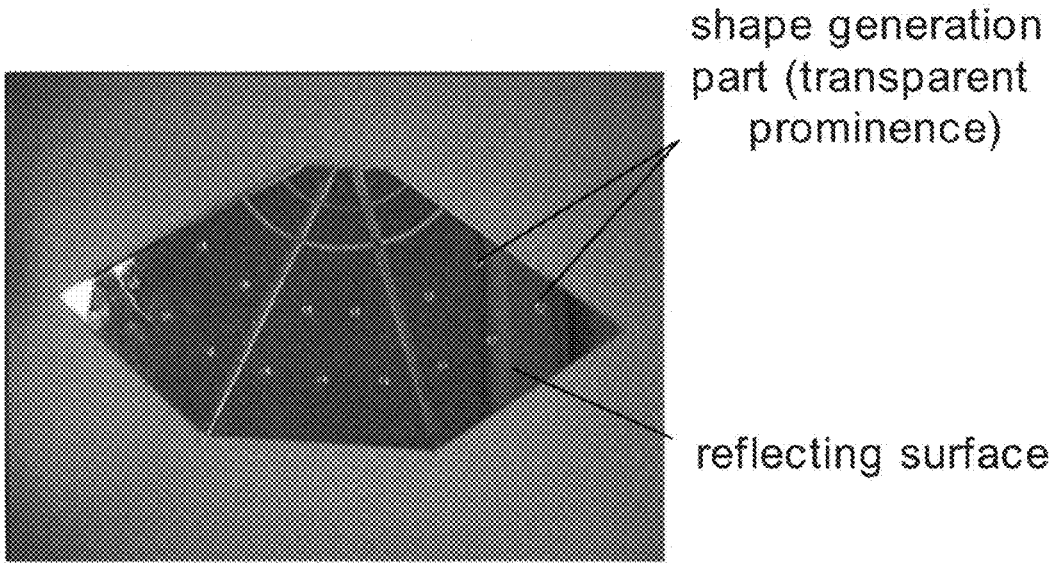
FIG. 6B is another view of the lamp fixture shown in FIG. 6A.

An example in which a three-dimensional shape is exhibited by transparent prominences on the reflecting surfaces is shown in FIGS. 6A and 6B. The size, shape, color, and position of the prominences can vary.

Although, in the illustrated embodiments, the lamp fixture has the shape of a triangular pyramid, it may be any polygonal pyramid or a cone. The more side planes, the more intricate and precise the shapes that can be exhibited.

Figure 7:
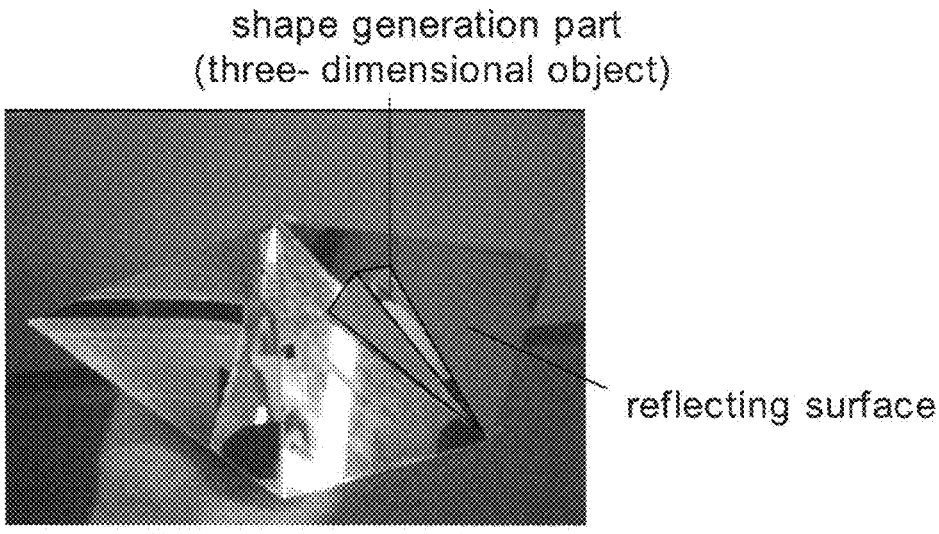
FIG. 7 is a view showing a lamp fixture according to another embodiment.

Reflecting surfaces or mirror surfaces used as shape generation parts are shown in FIG. 7. The light that is emitted from the light source is scattered and reflected, and thus still more three-dimensional shapes can be created.

Figure 8A:
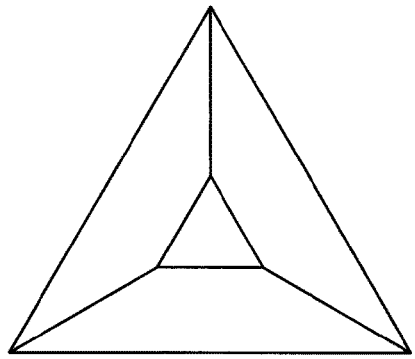
FIGS. 8A-8D, 9A-9F, and 10A-10B are views showing several embodiments of one or more lamp fixtures oriented in such ways as to be mounted in a vehicle.
Figure 8B:
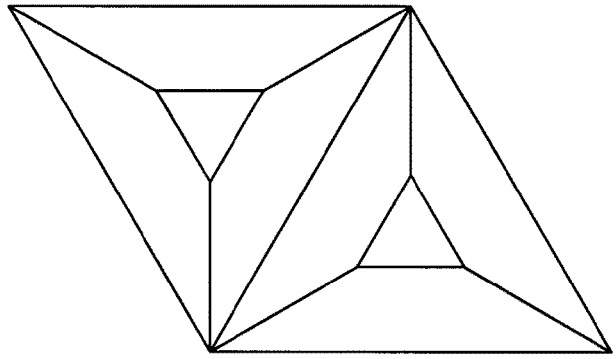

Mounting one or more lamp fixtures in a vehicle will now be described. As an example, if triangular pyramids as shown in FIG. 8A are mounted as shown in FIG. 8B, the light source mounting parts are offset from one another in the vertical direction in FIG. 8B, which is not pleasing to the eye.

Figure 8C:
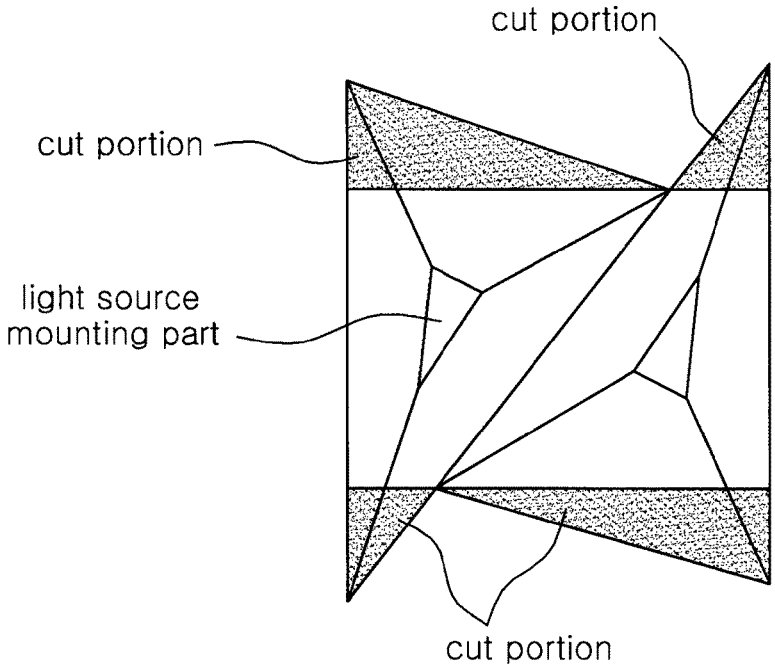
Figure 8D:
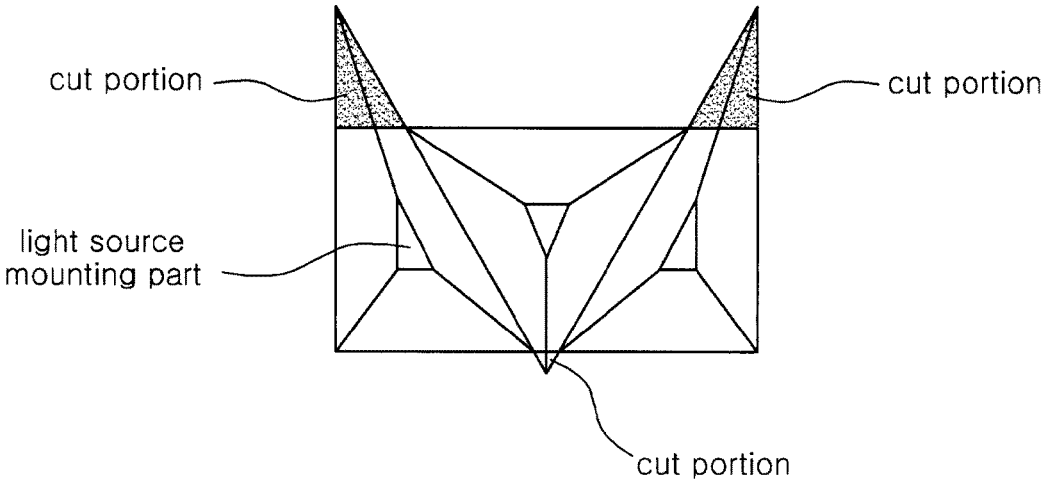
Figure 9A:
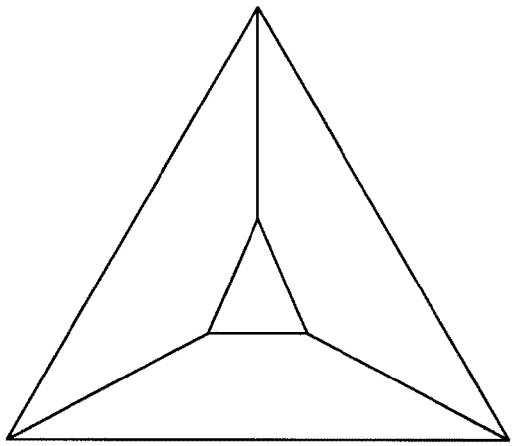
Figure 9B:
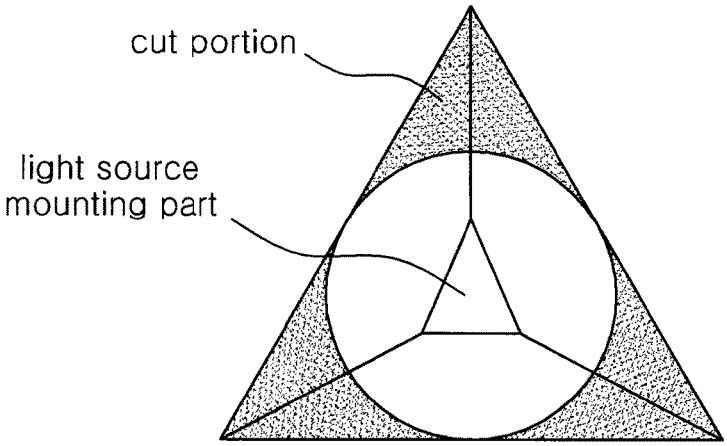
Figure 9C:
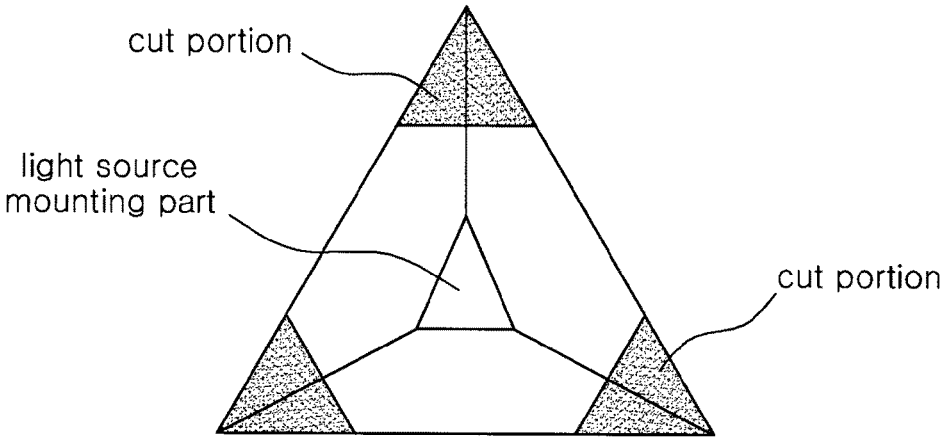
Figure 9D:
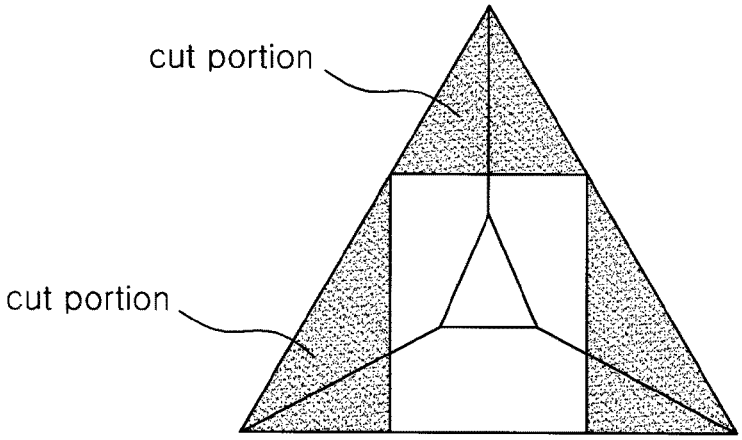
Figure 9E:
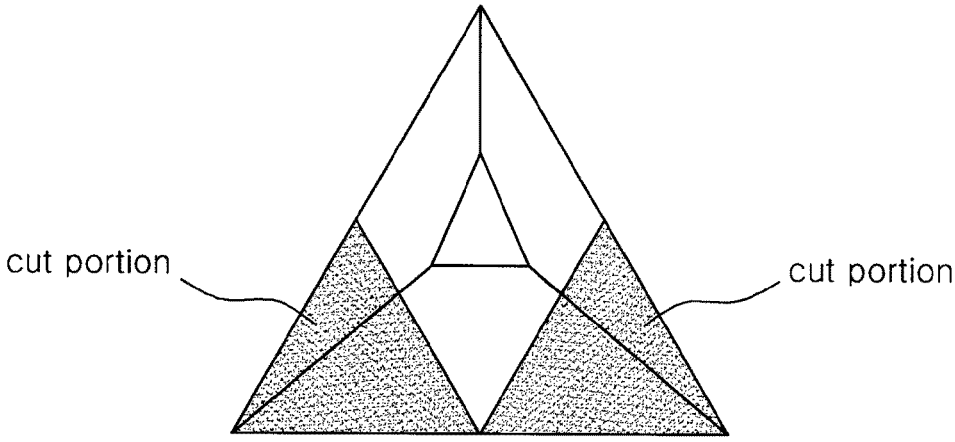
Figure 9F:
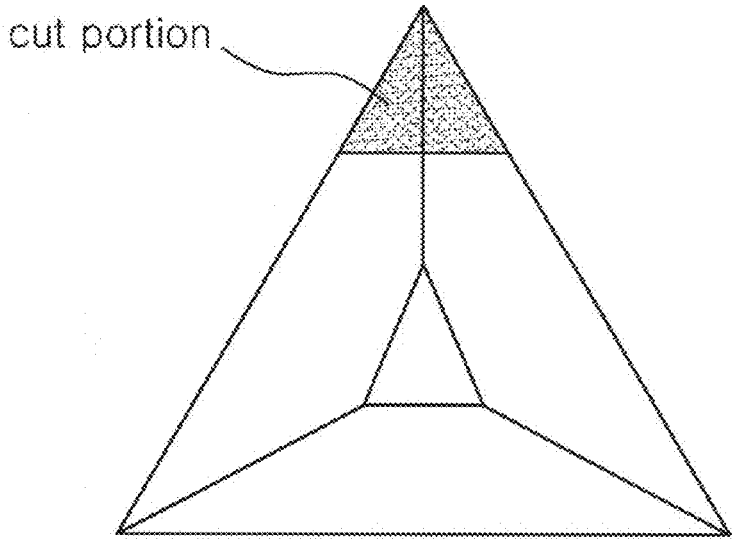

Accordingly, the, lamp fixtures may have the shapes shown in FIGS. 8C and 8D. The shaded portions may be removed. As a result, the light sources can be aligned.

Figure 10A:
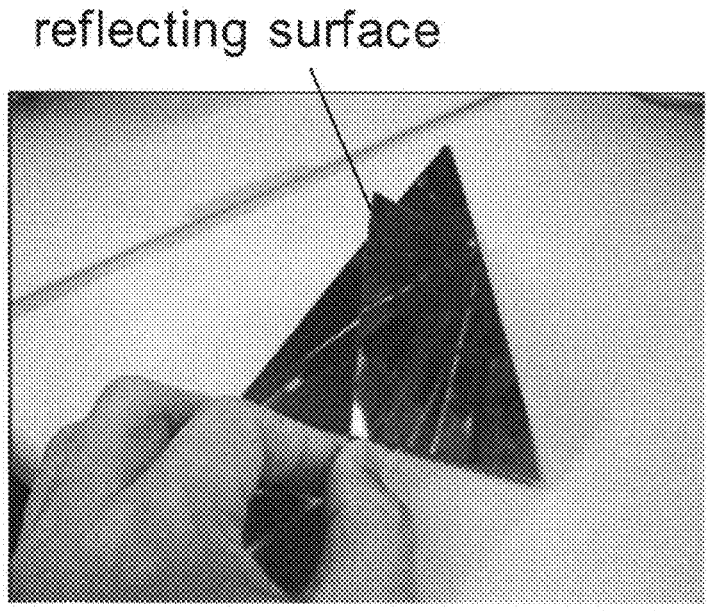
Figure 10B:
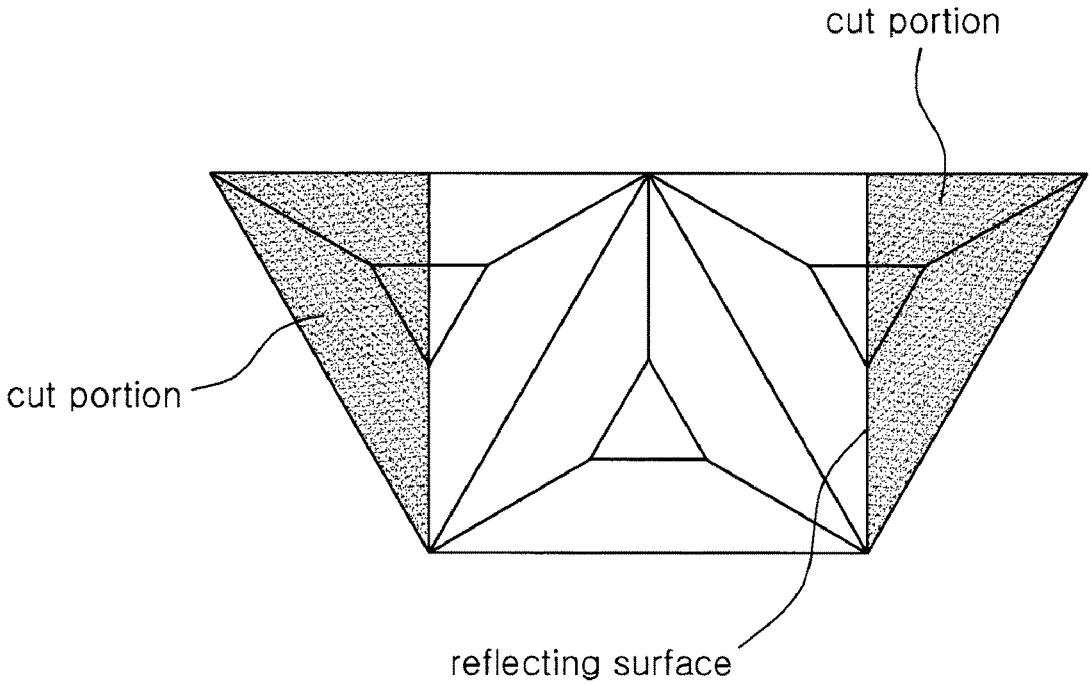

As another mounting example, shown in FIGS. 9A to 9F, the front vertex portions of each lamp fixture (which may impede mounting) may be removed. Meanwhile, in the case where parts of a polyhedron are removed, reflecting surfaces may be provided on the cut portions thereof, as shown in FIGS. 10A and 10B.

Figure 11:
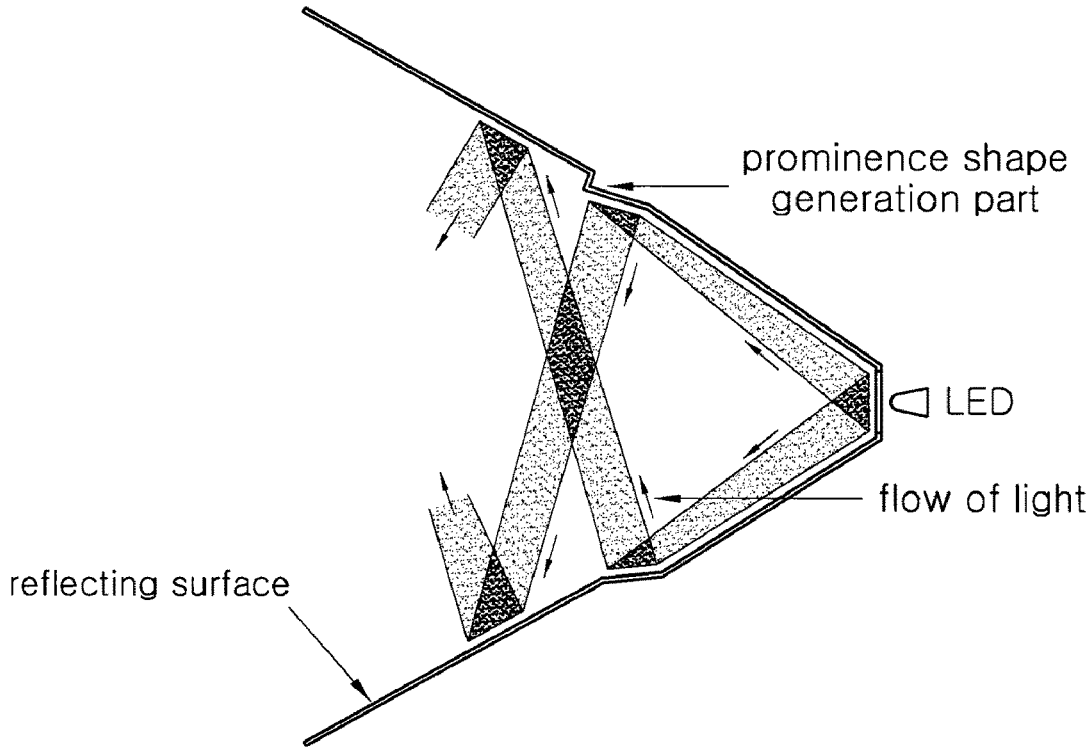
FIGS. 11-13 are views showing exemplary lamp fixtures and corresponding LEDs.

FIG. 11 shows the typical flow of light in the case where the shape generation part includes prominences provided on reflecting surfaces.

Figure 12:
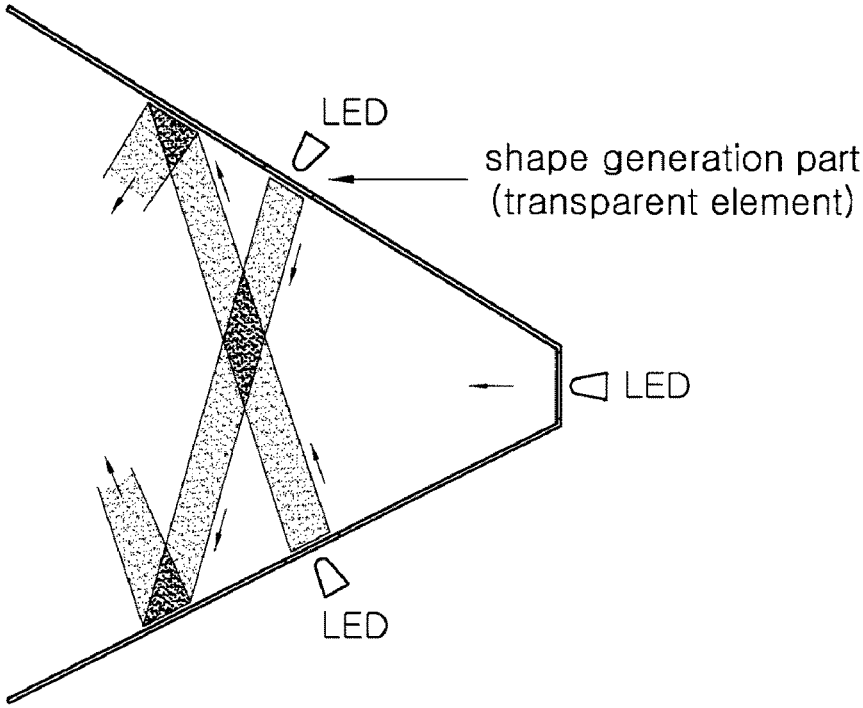

If the shape generation part includes transparent elements or holes on or in side planes of the lamp fixture, additional light sources may be mounted outside the side planes, as shown in FIG. 12. By doing so, light enters into the lamp fixture through the transparent elements or holes, and thus three-dimensional shapes can be exhibited.

Figure 13:
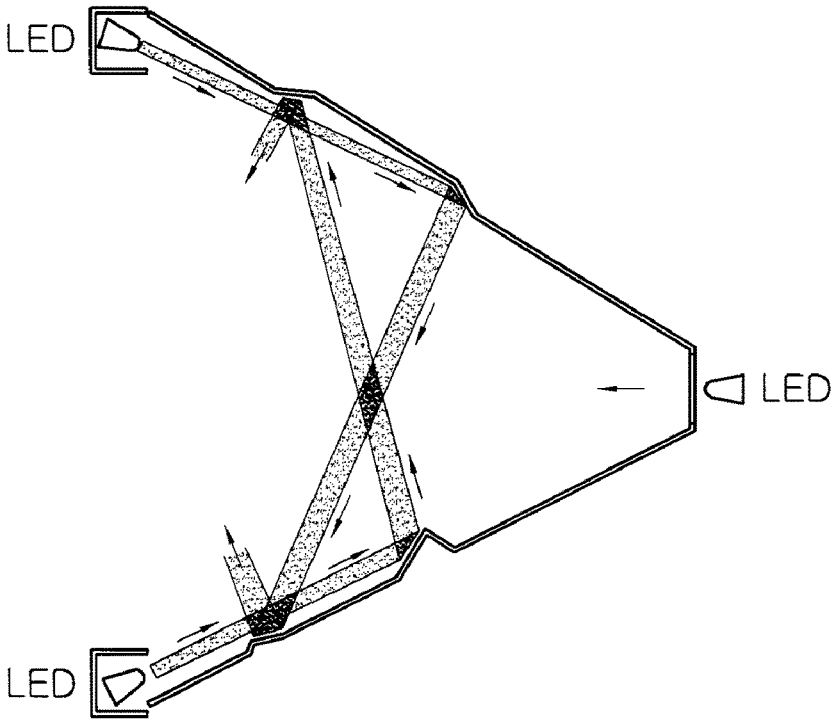

Uneven surfaces may be provided on or in the reflecting surfaces, in addition to transparent elements, transparent prominences and holes, by which the sensation of depth of the three-dimensional shapes created by the light source can be emphasized. If the shape generation part includes prominences or uneven surfaces, the layout shown in FIG. 13 may be adopted.

Figure 14:
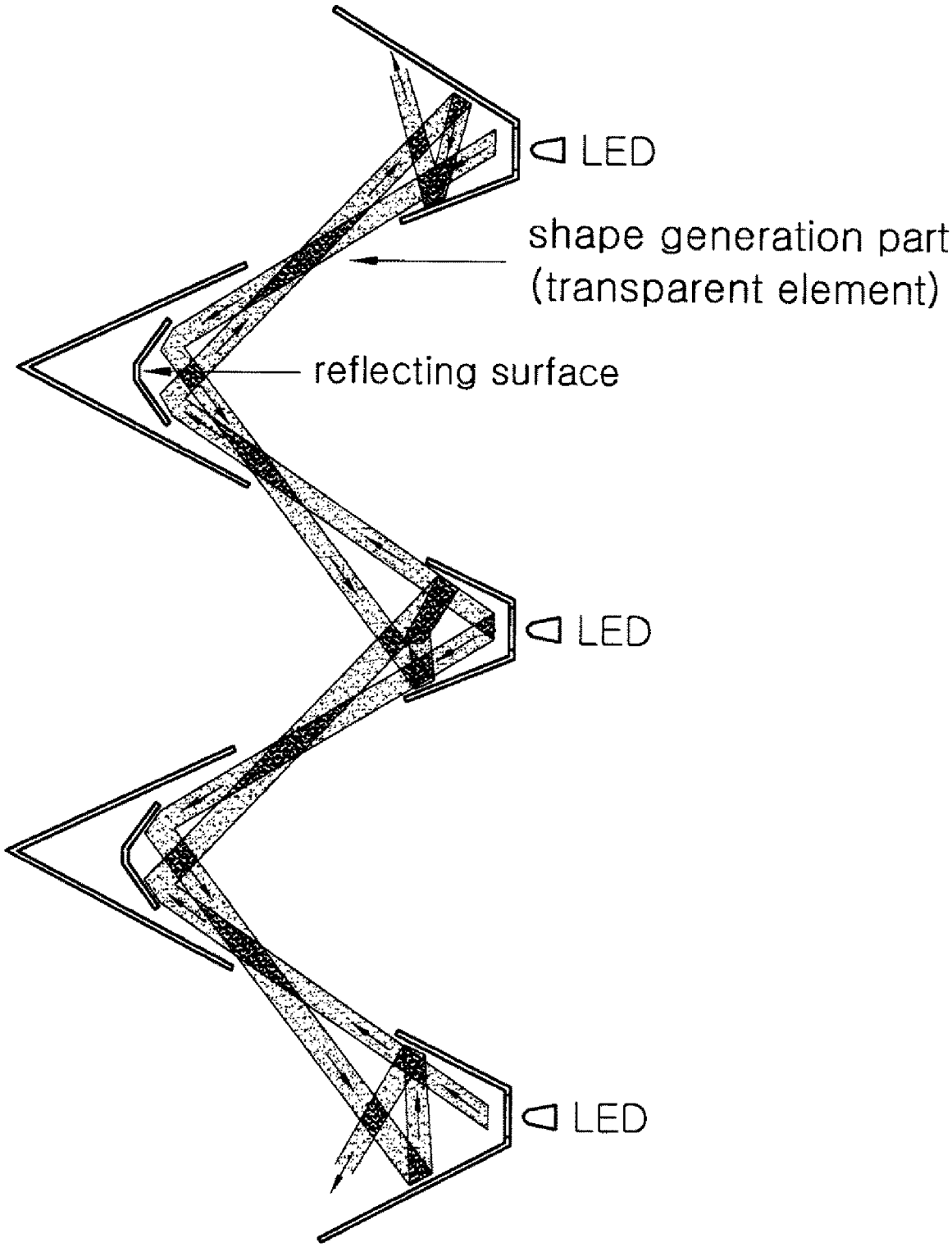
FIG. 14 is a view showing several lamp fixtures used together, and corresponding LEDs.

Meanwhile, in the case where a plurality of lamp fixtures is mounted to be close to each other, some other cost reduction methods may be used. As an example, reflecting surfaces may be disposed between two lamp fixtures such that light can travel between the lamp fixtures, as shown in FIG. 14. Costs can be reduced because the sensation of depth of three-dimensional shapes is maximized using a small number of light sources.

According to the above-described lamp fixtures, excellent aesthetics can be achieved even when the light source is not turned on and, in addition, the number of light sources that are used and the costs can be reduced. Furthermore, the lamp fixtures can not only exhibit geometrical three-dimensional shapes, but also produce a sensation as if light were scattered a long distance and an excellent design, so that it has high commercial value. Furthermore, various designs can be produced simply by modifying the shape generation part. In addition, in the case where a plurality of lamp fixtures is mounted in a vehicle parallel to each other, the light sources can be aligned.

Although the preferred embodiments of the present invention have been disclosed for illustrative purposes, those skilled in the art will appreciate that various modifications, additions and substitutions are possible, without departing from the scope and spirit of the invention as defined in the accompanying claims.

What is claimed is:

1. A lamp fixture comprising a hollow shape generally defined by a pyramid or a cone, the fixture comprising:

a light source mount at a vertex of the shape, configured for light from a light source to enter the shape therethrough;

reflecting inner surfaces on sides of the shape; and a design element on or in at least one of the sides, comprising a member selected from the group consisting of a slit, a hole, a transparent element, a color pattern, a three-dimensional object, a prominence, an uneven surface, and combinations thereof.

2. The lamp fixture as set forth in claim 1, wherein the transparent element comprises a color.

3. The lamp fixture as set forth in claim 1, wherein the three-dimensional object comprises a member selected from the group consisting of a color, a reflecting surface, and combinations thereof.

4. The lamp fixture as set forth in claim 1, wherein the design element is substantially defined by a member selected from the group consisting of a straight line, a curve, a figure, and combinations thereof.

5. The lamp fixture as set forth in claim 1, wherein the design element is on or in at least two of the sides.

6. The lamp fixture as set forth in claim 1, wherein the light source mount comprises a slanted opening.

7. The lamp fixture as set forth in claim 1, wherein at least one of the sides is curved.

8. The lamp fixture as set forth in claim 1, configured to be mounted adjacent an additional lamp fixture such that the light source is substantially aligned with a light source of the additional lamp fixture.

* * * * *